US010890183B2

(12) United States Patent
Kono et al.

(10) Patent No.: US 10,890,183 B2
(45) Date of Patent: Jan. 12, 2021

(54) SCROLL COMPRESSOR WITH FIXING FEATURES

(71) Applicant: Hitachi-Johnson Controls Air Conditioning, Inc., Tokyo (JP)

(72) Inventors: Takeshi Kono, Tokyo (JP); Eri Morita, Tokyo (JP); Yuusuke Uehashi, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 295 days.

(21) Appl. No.: 15/963,269

(22) Filed: Apr. 26, 2018

(65) Prior Publication Data

US 2018/0320689 A1 Nov. 8, 2018

(30) Foreign Application Priority Data

May 8, 2017 (JP) ..... 2017-092318

(51) Int. Cl.
*F04C 18/02* (2006.01)
*F04C 23/00* (2006.01)

(52) U.S. Cl.
CPC ..... *F04C 18/0215* (2013.01); *F04C 23/008* (2013.01); *F04C 2230/603* (2013.01); *F04C 2240/30* (2013.01)

(58) Field of Classification Search
CPC ..... F04C 18/0215; F04C 2230/603; F04C 2240/30
See application file for complete search history.

(56) References Cited

U.S. PATENT DOCUMENTS 6,270,328 B1 8/2001 Herbert et al.
6,280,165 B1 8/2001 Tsuchiya et al.
2018/0066510 A1* 3/2018 Walker ..... E21B 47/16

FOREIGN PATENT DOCUMENTS

JP 9-264271 A 10/1997
JP 2003-65255 A 3/2003
(Continued)

OTHER PUBLICATIONS

Machine translation of JP 09-264271A, Inventor: Ezaki et al; Title: Manufacture of Scroll Compressor, Published in 1997. (Year: 1997).*
(Continued)

*Primary Examiner* — Mary Davis
(74) *Attorney, Agent, or Firm* — Mattingly & Malur, PC

(57) ABSTRACT

A centering process and fastening bolt are not required for assembling a fixed scroll and an orbiting scroll of a scroll compressor that includes a hermetically sealed container and a compression mechanism. The fixed scroll includes a cylindrical portion formed in a circumferential direction on an outer circumferential side of the fixed wrap, a flange provided in the circumferential direction further outside of the cylindrical portion, and a first hole provided in the flange in an axial direction. The frame includes an inner circumferential surface, a flange provided in the circumferential direction further outside of the inner circumferential surface, and a second hole in the axial direction which is provided in a position of the flange opposite to the first hole. A knock pin is inserted in the first and second holes to prevent the frame and the fixed scroll from being displaced in the rotational direction.

11 Claims, 5 Drawing Sheets

(56) References Cited

FOREIGN PATENT DOCUMENTS

| | | | |
|---|---|---|---|
| KR | 2000-0047894 | A | 7/2000 |
| KR | 10-0739908 | B1 | 7/2007 |

OTHER PUBLICATIONS

Chinese Office Action received in corresponding Chinese Application No. 201810421019.1 dated Jun. 27, 2019.
Korean Office Action received in corresponding Korean Application No. 10-2018-0049575 dated Apr. 19, 2019.

* cited by examiner

SCROLL COMPRESSOR WITH FIXING FEATURES

CROSS REFERENCE TO RELATED APPLICATIONS

This application claims priority to Japanese Patent Application No. JP2017-092318, filed on May 8, 2017, the entire contents of which are incorporated by reference herein.

TECHNICAL FIELD

The present invention relates to a scroll compressor, and more particularly to an assembly of a scroll compressor for an air conditioner.

BACKGROUND ART

In an assembly of a scroll compressor including a frame, a fixed scroll and an orbiting scroll, up to now, as a method of centering the fixed scroll and the orbiting scroll, a method has been widely known in which the fixed scroll is fastened to the frame with the use of a fastening bolt while rotating a rotating shaft for driving the orbiting scroll.

The above centering method is advantageous in that if a rotation direction of the fixed scroll and the frame is defined by a knock pin or the like, a relationship of center positions between the fixed scroll and the frame can be automatically adjusted by the rotation of a rotation shaft. On the other hand, the above centering method suffers from problems that an assembling time of the compressor becomes longer and the number of parts increases because the fastening bolt for fixing the fixed scroll to the frame is required, resulting in an increase in the manufacturing cost and the material cost of the compressor.

As a solution to the above problems, there is a technique disclosed in U.S. Pat. No. 6,270,328 (PTL 1). The technique disclosed in U.S. Pat. No. 6,270,328 will be described below.

In the technique of U.S. Pat. No. 6,270,328, a circumferential groove having an arcuate surface (outer diameter portion) provided on an outer circumferential portion of the fixed scroll and a crankcase tower having an inner circumferential surface (inner diameter portion) formed on an outer circumferential portion of a crankcase (frame) and coming in close contact with the arcuate surface are closely fitted to each other, to thereby position both of the circumferential groove and the crankcase tower in a rotational direction and also position the circumferential groove and the crankcase tower on a plane perpendicular to the rotation axis.

In addition, the outer circumferential portion of the fixed scroll and the outer circumferential portion of the crankcase tower are sandwiched between a center shell and a lid cap of a sealed container so as to be fastened together.

As a result, the relationship of the center positions of the fixed scroll and the crankcase is defined by an arcuate surface of the circumferential groove and the inner circumferential surface of the crankcase, and the rotational direction is defined by a circumferential end of the circumferential groove and the circumferential end of the crankcase tower.

CITATION LIST

Patent Literature

PTL 1: U.S. Pat. No. 6,270,328

SUMMARY OF THE INVENTION

Technical Problem

In the above technique disclosed in U.S. Pat. No. 6,270,328, a coaxiality of the fixed scroll center and the arcuate portion, a coaxiality of a main bearing center of the crankcase and the inner circumferential surface, and a rotational positional precision between the circumferential end of the groove of the fixed scroll and the circumferential end of the crankcase tower are important. In other words, precise machining of the arcuate surface and the circumferential end of the groove, and the inner circumferential surface and the circumferential end of the crankcase tower is required.

However, in the technique disclosed in U.S. Pat. No. 6,270,328, in the case where the circumferential groove of the fixed scroll and the crankcase tower of the crankcase are divided into four portions in the circumferential direction, and the fixed scroll and the crankcase disclosed in U.S. Pat. No. 6,270,328 Is machined with a milling machine or the like, the cutting of a cutter is intermittently performed. This leads to such a problem that a sudden load is exerted on the cutter every time the cutter comes into contact with a workpiece, the cutter is broken down, and the piecework can be left uncut.

In particular, with regard to the crankcase, since a notch is provided between the crankcase and the crankcase tower, a strength of the crankcase tower is low and chattering (microvibration) is liable to occur. For that reason, there is also such a problem that a processing accuracy of the inner circumferential surface of the crankcase tower is lowered.

When the processing accuracy is lowered, there is a need to set a gap between the arcuate surface of the groove and the inner peripheral surface of the crankcase tower or a gap between the circumferential end of the groove and the circumferential end of the crankcase tower to be larger. As a result, the fixed scroll and the orbiting scroll are misaligned, the gap between the wraps is enlarged, and an excessive wrap contact occurs, which leads to a problem that the performance of the scroll compressor is deteriorated.

An object of the present invention is to provide a scroll compressor that is capable of positioning and assembling a fixed scroll and an orbiting scroll with high precision with the elimination of a process of centering the fixed scroll and the orbiting scroll during an assembling process.

Solution to Problem

In order to achieve the above object, according to one aspect of the present invention, there is provided a scroll compressor including: a hermetically sealed container; and a compression mechanism unit that is disposed in the hermetically sealed container and includes a frame, a fixed scroll having a fixed wrap, and an orbiting scroll having an orbiting wrap which is engaged with the fixed wrap, and disposed between the frame and the fixed scroll, in which the fixed scroll includes a cylindrical portion which is formed in a circumferential direction on an outer circumferential side of the fixed wrap, a flange which is provided in the circumferential direction further outside of the cylindrical portion, and a first hole which is provided in the flange in an axial direction, the frame includes an inner circumferential surface into which the cylindrical portion of the fixed scroll is inserted and fitted, a flange which is provided in the circumferential direction further outside of the inner circumferential surface, and a second hole in the axial direction which is provided in a position of the flange opposite to the first hole, and the scroll compressor further includes: a knock pin that is inserted in the first hole and the second hole to prevent the frame and the fixed scroll from being displaced in the rotational direction; and a fixing unit that fixes the frame and the fixed scroll to the hermetically sealed container.

According to another aspect of the present invention, there is provided a scroll compressor including: a hermetically sealed container; and a compression mechanism unit that is disposed in the hermetically sealed container and includes a frame, a fixed scroll having a fixed wrap, and an orbiting scroll having an orbiting wrap which is engaged with the fixed wrap, and disposed between the frame and the fixed scroll, in which the fixed scroll includes a cylindrical portion which is formed in a circumferential direction on an outer circumferential side of the fixed wrap and a flange which is provided in the circumferential direction further outside of the cylindrical portion, the frame includes an inner circumferential surface into which the cylindrical portion of the fixed scroll is inserted and fitted and a flange which is provided in the circumferential direction further outside of the inner circumferential surface, and the scroll compressor further includes: a fixing unit that positions the fixed scroll and the frame in a rotational direction and fixes the fixed scroll and the frame; and a fixing unit that fixes at least one of the frame and the fixed scroll to the hermetically sealed container.

Advantageous Effects of Invention

According to the present invention, there can be obtained the scroll compressor capable of eliminating the process of centering the fixed scroll and the orbiting scroll during the assembling process, and positioning the fixed scroll and the orbiting scroll with high accuracy and assembling the fixed scroll and the orbiting scroll together.

DESCRIPTION OF EMBODIMENT

Figure 1:
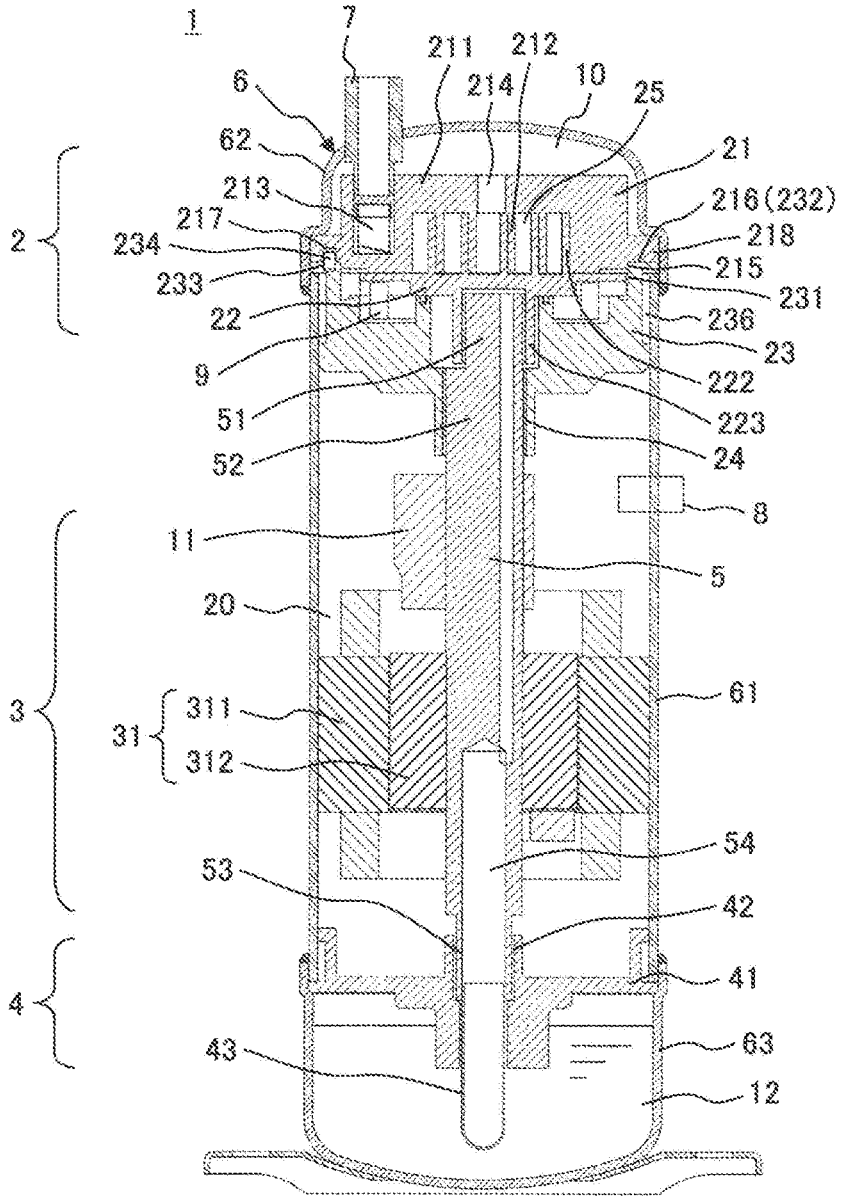
FIG. 1 is a longitudinal cross-sectional view showing a scroll compressor according to a first embodiment of the present invention.

Hereinafter, specific embodiments of a scroll compressor according to the present invention will be described with reference to the accompanying drawings. The same reference numerals designate identical or corresponding parts in the respective drawings.

First Embodiment

A scroll compressor according to a first embodiment of the present invention will be described with reference to FIGS. 1 to 6.

First of all, an overall configuration of the scroll compressor according to the first embodiment will be described with reference to FIG. 1. FIG. 1 is a longitudinal cross-sectional view showing the overall configuration of the scroll compressor according to the first embodiment.

The scroll compressor 1 is configured such that a compression mechanism unit 2, a drive unit 3, an oil supply mechanism unit 4, and a rotating shaft 5, and the like are accommodated in a hermetically sealed container 6. In the present embodiment, the compression mechanism unit 2, the drive unit 3, and the oil supply mechanism unit 4 are disposed in the stated order from an upper portion shown in FIG. 1 in the hermetically sealed container 6, and the compression mechanism unit 2, the drive unit 3, and the oil supply mechanism unit 4 are coupled to each other through the rotating shaft 5.

The compression mechanism portion 2 includes a fixed scroll 21, an orbiting scroll 22, and a frame (crankcase) 23 as basic elements. The frame 23 is fixed to the hermetically sealed container 6 and a main bearing 24 is disposed.

The fixed scroll 21 includes a base plate 211, a fixed wrap (scroll spiral wrap) 212, a suction port 213, and a discharge port 214 and the like as basic elements, and the fixed wrap 212 is erected vertically to the base plate 211.

The orbiting scroll 22 includes a base plate 221, an orbiting wrap (scroll spiral wrap) 222, an orbiting bearing 223, and the like as basic elements, and the orbiting wrap 222 is erected vertically on one side of the base plate 221. The orbiting bearing 223 is formed to protrude vertically on a side of the base plate 221 opposite to the scroll spiral wrap.

A compression chamber 25 formed by engaging the fixed scroll 21 with the orbiting scroll 22 is subjected to compressing operation in which a volume of the compression chamber 25 decreases with the orbiting motion of the orbiting scroll 22. In the compression operation, a gas is drawn into the compression chamber 25 through a suction pipe 7 and the suction port 213 in association with the orbiting motion of the scroll 22, and the suctioned gas undergoes a compression stroke and is discharged from the discharge port 214 of the fixed scroll 21 into a discharge chamber 10 in the hermetically sealed container 6. Then, the discharged gas is further discharged from the hermetically sealed container 6 through a discharge pipe 8. Therefore, a space in the hermetically sealed container 6 is kept in a discharge pressure space.

The hermetically sealed container 6 includes a center shell (case) 61, a lid cap 62, and a bottom cap 63. The lid cap 62 and the bottom cap 63 are fitted to the center shell 61 so as to cover an outside of the center shell 61, and fitting ends of the lid cap 62 and the bottom cap 63 are welded to the ends of the center shell 61 by being heated obliquely downwardly or obliquely upwardly by a welding torch.

An interior of the hermetically sealed container 6 is divided into the discharge chamber 10 and an electric motor chamber 20 by the compression mechanism unit 2.

The drive unit 3 for driving the orbiting scroll 22 in an orbiting manner includes an electric motor 31 having a stator 311 and a rotor 312, the rotating shaft 5, an Oldham coupling 9 which is a main component of a rotation prevention mechanism of the orbiting scroll 22, the frame 23, the main bearing 24, and the orbiting bearing 223 as basic elements.

The electric motor 31 configures a rotatory drive unit that drives the compression mechanism unit 2 through the rotating shaft 5 and includes the stator 311 and the rotor 312 as basic elements. An outer circumferential surface of the stator 311 is attached to an inner circumferential surface of the center shell 61 of the sealed container 6 in substantially close contact with the inner circumferential surface of the center shell 61.

A lower frame 41 is fixedly provided in a lower portion of the hermetically sealed container 6 and an auxiliary bearing 42 that supports a lower portion of the rotating shaft 5 is provided in the lower frame 41.

The rotating shaft 5 includes a crank pin (eccentric pin portion) 51, a main shaft portion 52 and an auxiliary bearing support portion 53. The main shaft portion 52 and the auxiliary bearing support portion 53 are formed coaxially, the main shaft portion 52 is rotatably supported by the main bearing 24, and the auxiliary bearing support portion 53 is rotatably supported by the auxiliary bearing 42.

An axis of the crank pin 51 is eccentric to the main shaft portion 52 and is inserted into the orbiting bearing 223 of the orbiting scroll 22. When the rotation of the rotating shaft 5 coupled to the electric motor 31 causes the crank pin 51 to rotate eccentrically, the orbiting scroll 22 performs the orbiting motion without rotating relative to the fixed scroll 21 due to the Oldham coupling 9.

A balance weight 11 is attached to the rotating shaft 5 between the main bearing 24 and the electric motor 31 by press fitting or the like.

The oil supply mechanism unit 4 is configured by an oil supply pipe 43 or the like attached to a lower end of the rotating shaft 5. When the rotating shaft 5 rotates, the oil supply pipe 43 rotates together with the rotation of the rotating shaft 5. Oil in an oil reservoir 12 is suctioned up into an oil passage 54 in the rotating shaft 5 due to a centrifugal pump action. The oil is then supplied to the bearings such as the main bearing 24, the auxiliary bearing 42 and the orbiting bearing 223 and sliding portions between the Oldham's coupling 9 and the fixed scroll 21, and the orbiting scroll 22, and the like.

Figure 2:
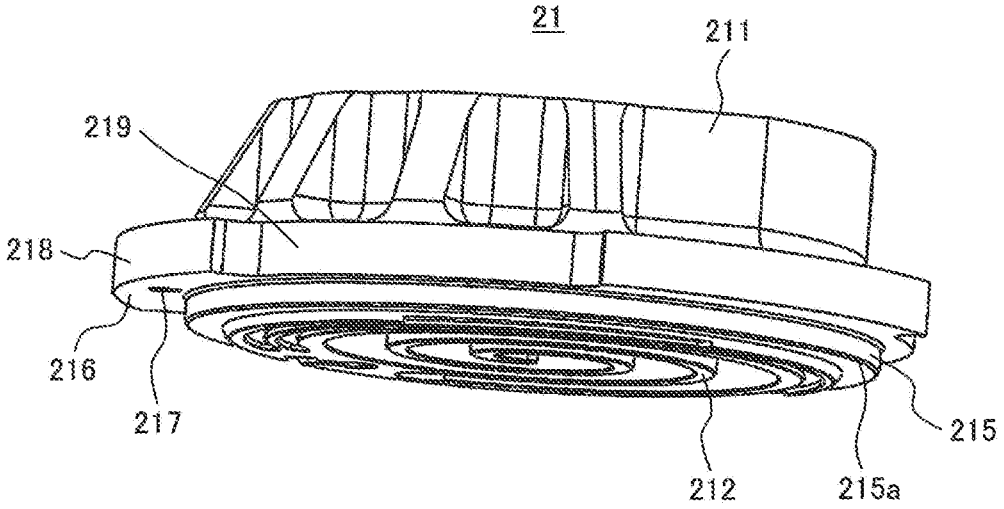
FIG. 2 is a perspective view of a fixed scroll shown in FIG. 1 when viewed obliquely from below.

The positioning and fixing of the fixed scroll 21 and the frame 23 will be described with reference to FIGS. 2 to 6. First, a structure of the fixed scroll 21 and a configuration of the frame 23 according to the present embodiment will be described with reference to FIGS. 2 and 3. FIG. 2 a perspective view of the fixed scroll shown in FIG. 1 when viewed obliquely from below, and FIG. 3 is a perspective view of the frame shown in FIG. 1 when viewed obliquely from above.

As shown in FIG. 2, the fixed scroll 21 according to the present embodiment has a cylindrical portion 215 formed on an outer circumferential portion of the fixed wrap 212. In the present embodiment, a chamfered portion 215*a* is formed on an outer circumferential end (corner) of the cylindrical portion 215. Further, multiple (three in this example) flanges 218 each having an axial contact surface 216 with the frame 23 are formed circumferentially at substantially regular intervals. At least one of the flanges 218 is formed with a first hole 217 having an elongated round shape in the contact surface.

Figure 3:
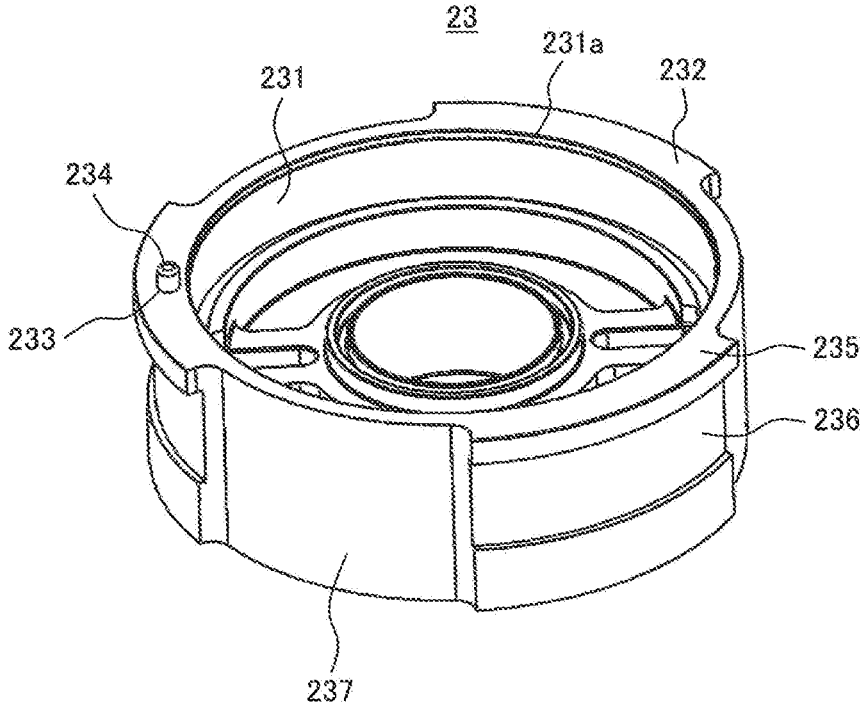
FIG. 3 is a perspective view of a frame shown in FIG. 1 when viewed obliquely from above.

On the other hand, as shown in FIG. 3, the frame 23 is formed with an inner circumferential surface 231 for fitting the cylindrical portion 215 of the fixed scroll 21 into an upper inner circumference of the frame 23. In the present embodiment, a chamfered portion 231*a* is also formed at an upper end (end) of the inner circumferential surface 231. Multiple flanges 235 each having an axial contact surface 232 with the fixed scroll 21 are formed circumferentially (three places in this example) at substantially regular intervals and at positions corresponding to the flanges 218 of the fixed scroll 21.

In other words, the contact surfaces 216 of the flanges 218 of the fixed scroll 21 and the contact surfaces 232 of the flanges 235 of the frame 23 can be brought into close contact with each other in the axial direction. Further, the flanges 218 of the fixed scroll 21 and the flanges 235 of the frame 23 are provided at multiple positions corresponding to each other at intervals in the circumferential direction. With the above configuration, the communication passages 219 and 237 for communicating the discharge chamber 10 and the electric motor chamber 20 shown in FIG. 1 with each other are defined as shown in FIGS. 2 and 3. As a result, a gas or oil discharged from the discharge port 214 of the fixed scroll 21 can flow to the electric motor chamber 20 side.

A circular second hole 233 is provided at a position corresponding to the first hole 217 of the fixed scroll 21 and in the contact surface 232 of the flange of the frame 23. Also, a knock pin 234 is inserted and fixed into the second hole 233 by press fitting or the like. A clearance portion 236 to be described later is formed on an outer circumferential surface of each flange 235 on a side opposite to the fixed scroll 21.

Figure 4:
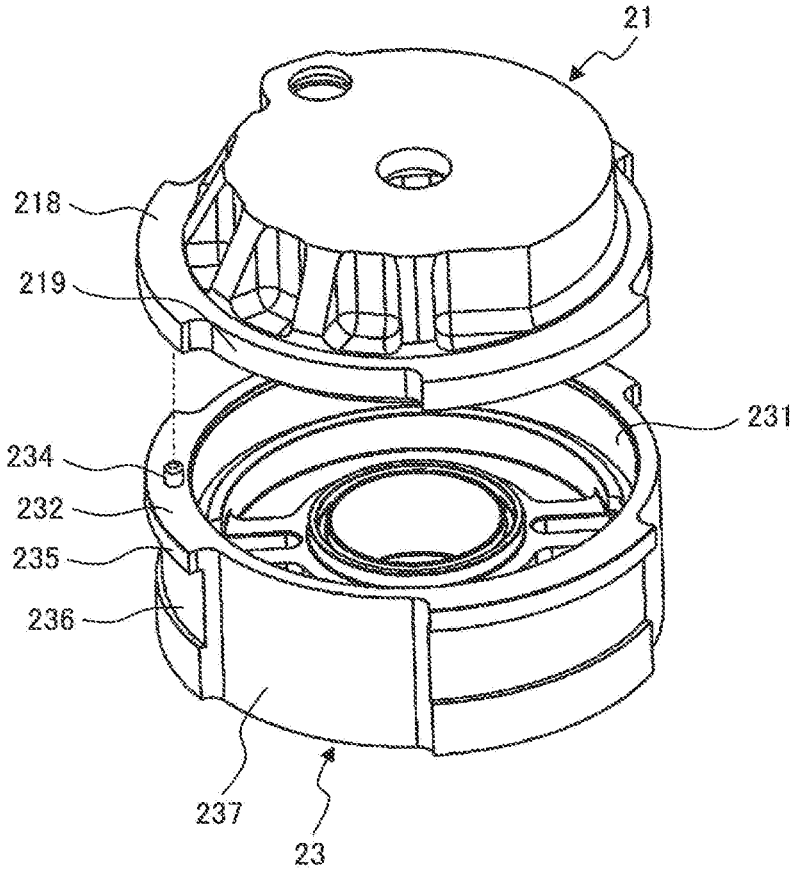
FIG. 4 is a perspective view illustrating an assembly of the fixed scroll shown in FIG. 2 and the frame shown in FIG. 3.

The fixed scroll 21 and the frame 23 configured as described above are assembled together as shown in FIG. 4. FIG. 4 is a perspective view illustrating the assembly of the fixed scroll shown in FIG. 2 and the frame shown in FIG. 3. As shown in FIG. 4, the fixed scroll 21 and the frame 23 are fitted to each other with the cylindrical portion 215 of the fixed scroll 21 inserted into the inner circumferential surface 231 of the frame 23.

The operation of inserting the cylindrical portion 215 of the fixed scroll 21 into the inner circumferential surface 231 of the frame 23 is facilitated by the chamfered portion 215*a* formed in the cylindrical portion 215 and the chamfered portion 231*a* formed in the inner circumferential surface 231. Incidentally, both of the chamfered portion 215*a* and the chamfered portion 231*a* may be provided as in the present embodiment, or any one of the chamfered portion 215*a* and the chamfered portion 231*a* may be provided. In addition, the operation of inserting the cylindrical portion 215 into the inner circumferential surface can be facilitated even if the cylindrical portion 215 and the inner circumferential surface 231 are each formed into a tapered surface instead of the chamfered portions 215*a* and 231*a*. Further, it is not indispensable to provide the chambered portions 215*a*, 231*a*, or the like, and the chambered portions 215*a* and 231*a* may be omitted.

Simultaneously with the operation of inserting the cylindrical portion 215 of the fixed scroll 21 into the inner circumferential surface 231 of the frame 23, the knock pin 234 fixed into the second hole 233 of the frame 23 is inserted into the first hole 217 formed in the fixed scroll 21, and the fixed scroll 21 is assembled with the frame 23.

The positioning of cores of the fixed scroll 21 and the frame 23, that is, the radial positioning of the fixed scroll 21 and the frame 23 is determined according to the cylindrical portion 215 and the inner circumferential surface 231, and the positioning of the fixed scroll 21 and the frame 23 in the rotational direction (circumferential direction) is determined according to the first hole 217 and the knock pin 234.

In this example, the cylindrical portion 215 is fitted into the inner circumferential surface 231 with a gap of about 0 to several tens of microns, or by press-fitting to a degree that the deformation of the components does not affect the function of the scroll compressor.

Next, a detailed structure of a portion of the first hole 217 into which the knock pin 234 is inserted in the fixed scroll 21 will be described with reference to an enlarged bottom view of a main portion of the fixed scroll shown in FIG. 5.

Figure 5:
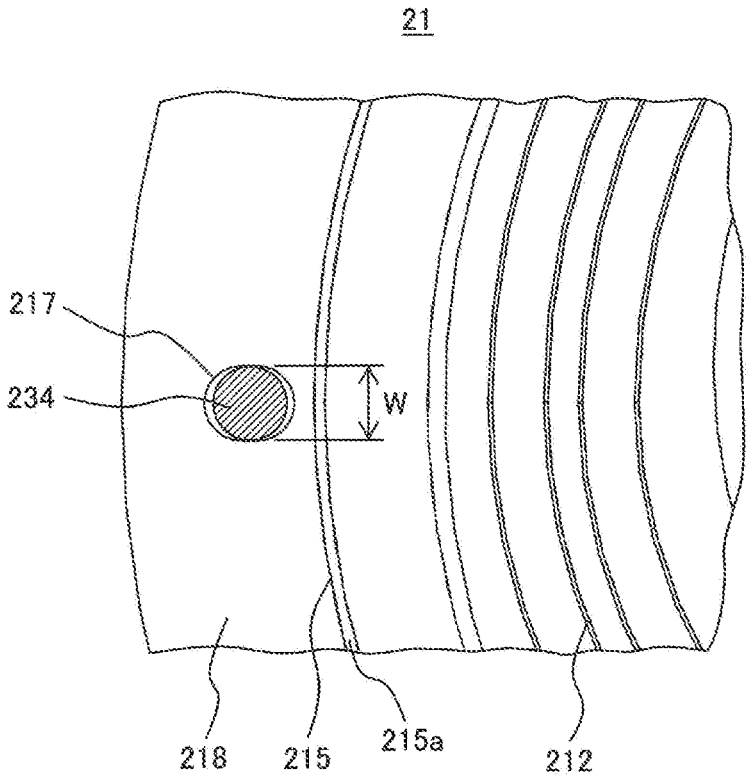
FIG. 5 is an enlarged bottom view showing a main portion of the fixed scroll shown in FIG. 2.

As shown in FIG. 5, the first hole 217 provided in the flange 218 of the fixed scroll 21 is formed into an elongated round shape, the elongated round hole 217 has parallel surfaces, and a width W of the parallel surfaces is formed to be equal to tens of microns larger than a diameter of the knock pin 234. For example, in the case where the gap between the width W of the parallel portion and the knock pin 234 is set to 50 μm, if a distance from a center of the frame 23 to a center of the knock pin 234 is 100 mm, an angle at which the fixed scroll 21 can be tilted in the rotational direction is 0.03 degrees. As described above, the positioning of the fixed scroll 21 relative to the frame 23 in the rotational direction can be set with high accuracy. The reason why the first hole 217 is formed in the elongated round shape is that an assembling error between the fixed scroll 21 and the frame 23 in the radial direction is absorbed.

Incidentally, in the present embodiment, the first hole 217 provided in the fixed scroll 21 has an elongated round shape, and the second hole 233 provided in the frame 23 has a circular shape. Alternatively, even if the first hole 217 are formed in the circular shape and the second hole 233 is formed in the elongated round shape, the same advantages can be obtained. In that case, the knock pin 234 is inserted and fixed into the circular first hole 217 by press fitting.

In addition, referring to FIG. 5, reference numeral 218 denotes the flanges of the fixed scroll 21, 215 denotes the cylindrical portion (outer circumferential surface of the cylindrical portion), 215*a* denotes the chamfered portion, and 212 denotes the fixed wrap.

Figure 6:
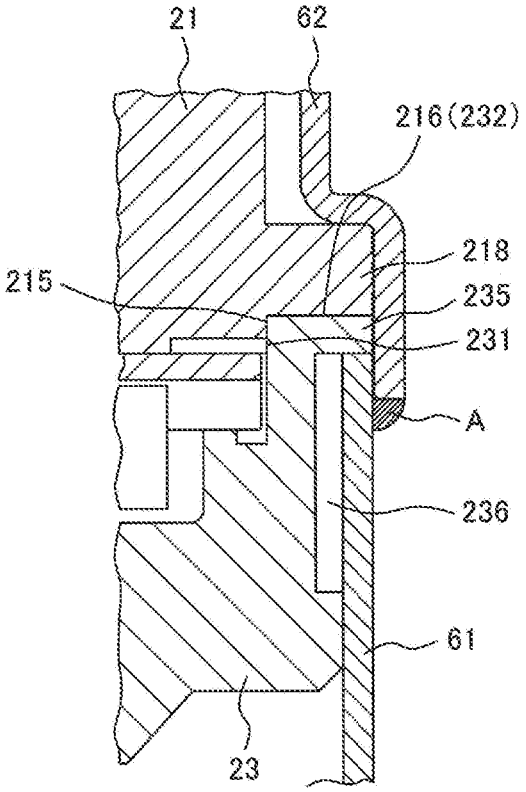
FIG. 6 is an enlarged view showing a main portion of a fastening portion between the fixed scroll, the frame, and a hermetically sealed container shown in FIG. 1.

Next, the fixing of the fixed scroll 21 and the frame 23 and the fixing (fastening) of the fixed scroll 21 and the frame 23 to the hermetically sealed container 6 will be described with reference to FIG. 6. FIG. 6 is an enlarged view showing an enlarged main portion of a fastening portion of the fixed scroll 21, the frame 23, and the hermetically sealed container 6 shown in FIG. 1.

The flanges 218 are provided on the outer circumferential portion of the fixed scroll 21 and the flanges 235 are provided on the outer circumferential portion of the frame 23. The frame 23 is pressed and fitted into the center shell 61 such that the flanges 235 of the frame 23 are abutted against an end surface (upper end surface) of the center shell 61.

On the other hand, the fixed scroll 21 is assembled to the frame 23 with the use of the positioning unit described with reference to FIGS. 2 to 5, and the flanges 218 of the fixed scroll 21 are sandwiched between the center shell 61 and the lid cap 62 together with the flanges 235 of the flame 23. The lid cap 62 is welded to the center shell 61 at a fitting end A in a state where the flanges 218 and 235 are pressed downward from above. As a result, the fixed scroll 21 and the frame 23 are fastened to each other, and also fixed to the hermetically sealed container 6.

In addition, the clearance portion 236 is provided on the outer circumferential portion of the frame 23 so that even if the welded portion of the center shell 61 is deformed by the welding between the center shell 61 and the lid cap 62, the deformation does not affect the frame 23.

With the configuration described above, no fastening bolt for fastening the fixed scroll 21 and the frame 23 together can be required, and there is no need to weld for fixing the compression mechanism unit 2 to the center shell 61. This makes it possible to reduce the number of components and improve an assembly property.

According to the first embodiment of the present invention described above, the process of centering the fixed scroll and the orbiting scroll during the assembling process of the scroll compressor can be eliminated, and the fastening component such as the fastening bolt for fastening the fixed scroll and the frame to each other can be made unnecessary. Therefore, the manufacturing cost and the material cost can be reduced. In addition, since the fixed scroll and the frame can be positioned and assembled together with high accuracy, the scroll compressor capable of achieving high performance can be obtained.

In the first embodiment described above, the flanges 218 provided in the circumferential direction outside the cylindrical portion 215 of the fixed scroll 21 as well as the first hole 217 formed in any flange are provided. On the other hand, the frame 23 is provided with the flanges 235 provided in the circumferential direction outside the inner circumferential surface 231 into which the cylindrical portion 215 is inserted and fitted, and the second hole 233 formed in any flange. The knock pin is provided to be inserted into the first hole 217 and the second hole 233 so as to prevent the frame 23 and the fixed scroll 21 from being displaced in the rotational direction. Alternatively, the above configuration can be modified as follows.

In other words, in place of the knock pin, a fixing unit such as a bolt may be used to position and fix the fixed scroll and the frame in the rotational direction, and at least one of the frame and the fixed scroll may be fixed to the hermetically sealed container 6 by a fixing unit such as plug welding. In the configuration described above, although there is a need to perform the fastening operation with bolts, there can be obtained such advantages that the process of centering the fixed scroll 21 and the orbiting scroll 22 during the assembling process can be made unnecessary, and the fixed scroll and the orbiting scroll can be positioned and assembled together with high precision.

Meanwhile, the present invention is not limited to the embodiments described above, and includes various modifications. The embodiments described above have been described in detail for facilitating the understanding of the present invention, and the present invention is not necessarily limited to the provision of all the configurations described above. For example, although the first hole 217 or the second hole 233 is formed in the elongated round shape in the embodiment described above, the first hole 217 or the second hole 233 are not necessarily formed in the elongated round shape as long as the assembling error in the radial direction of the fixed scroll 21 and the frame 23 can be reduced. For example, the first hole 217 or the second hole 233 may be formed in a circular shape or an elliptical shape.

REFERENCE SIGNS LIST

1 . . . scroll compressor,
2 . . . compression mechanism unit,
21 . . . fixed scroll, 211 . . . base plate,
212 . . . scroll spiral wrap (fixed wrap),
213 . . . suction port, 214 . . . discharge port,
215 . . . cylindrical portion, 215*a* . . . chamfered portion,
216 . . . contact surface, 217 . . . first hole,
218 . . . flange, 219 . . . communication passage,
22 . . . orbiting scroll, 221 . . . base plate,
222 . . . scroll spiral wrap (orbiting wrap),

223 . . . orbiting bearing,
23 . . . frame, 231 . . . inner circumferential surface,
231*a* . . . chamfered portion, 232 . . . contact surface,
233 . . . second hole, 234 . . . knock pin, 235 . . . flange,
236 . . . clearance portion, 237 . . . communication passage,
24 . . . main bearing, 25 . . . compression chamber,
3 . . . drive unit, 31 . . . electric motor, 311 . . . stator,
312 . . . rotor,
4 . . . oil supply mechanism unit, 41 . . . lower frame,
42 . . . auxiliary bearing, 43 . . . oil supply pipe,
5 . . . rotating shaft, 51 . . . crank pin (eccentric pin portion),
52 . . . main shaft portion,
53 . . . auxiliary bearing support portion, 54 . . . oil passage,
6 . . . hermetically sealed container,
61 . . . center shell (case), 62 . . . lid cap, 63 . . . bottom cap,
7 . . . suction pipe, 8 . . . discharge pipe,
9 . . . Oldham coupling, 10 . . . discharge chamber,
11 . . . balance weight, 12 . . . oil reservoir,
20 . . . electric motor chamber.

What is claimed is:

1. A scroll compressor, comprising:

a hermetically sealed container including at least a cylindrical center shell; and a compression mechanism unit that is disposed in the hermetically sealed container and includes a frame, a fixed scroll having a fixed wrap, and an orbiting scroll having an orbiting wrap which is engaged with the fixed wrap, and is disposed between the frame and the fixed scroll, wherein the fixed scroll includes a cylindrical portion which is formed in a circumferential direction on an outer circumferential side of the fixed wrap, a flange which is provided in the circumferential direction further outside of the cylindrical portion, and a first hole which is disposed in the flange in an axial direction, the frame includes an inner circumferential surface into which the cylindrical portion of the fixed scroll is inserted and fitted, a flange which is provided in the circumferential direction further outside of the inner circumferential surface, and a second hole in the axial direction which is disposed in a position of the flange opposite to the first hole, and the scroll compressor further comprises:

a knock pin that is inserted in the first hole and the second hole to prevent the frame and the fixed scroll from being displaced in a rotational direction; and a weld that fixes the frame and the fixed scroll to the hermetically sealed container, wherein a first portion of an outer surface of the frame below the flange of the frame in the axial direction extends outward in a radial direction less than a second portion of the outer surface of the frame that is below the first portion in the axial direction and that contacts an inner surface of the cylindrical center shell.

2. The scroll compressor according to claim 1, wherein the hermetically sealed container includes at least the cylindrical center shell and a lid cap that covers an open end surface of the center shell, and wherein the weld fixes the frame and the fixed scroll such that the flange of the fixed scroll and the flange of the frame is sandwiched between the center shell and the lid cap.

3. The scroll compressor according to claim 2, wherein a plurality of the flanges of the fixed scroll are formed at a predetermined interval in the circumferential direction, and a plurality of the flanges of the frame are formed at a predetermined interval in the circumferential direction and disposed at positions corresponding to the flanges of the fixed scroll.

4. The scroll compressor according to claim 2, wherein the lid cap is fixed to the center shell by welding.

5. The scroll compressor according to claim 4, wherein a portion where the lid cap is welded to the center shell is placed on the outer circumferential side of the frame and a clearance portion in which a space is provided between the outer circumferential portion of the frame and the hermetically sealed container is provided in the outer circumferential portion of the frame corresponding to the welded portion.

6. The scroll compressor according to claim 1, wherein at least one of an outer circumferential end of the cylindrical portion of the fixed scroll and an end of the inner circumferential surface of the frame is chamfered.

7. The scroll compressor according to claim 1, wherein a gap between the cylindrical portion of the fixed scroll and the inner circumferential surface of the frame is set to 0 to several tens of microns.

8. The scroll compressor according to claim 1, wherein the cylindrical portion of the fixed scroll is pressed and fitted into the inner circumferential surface of the frame.

9. The scroll compressor according to claim 1, wherein the first hole disposed in the fixed scroll is an elongated round shape and the second hole disposed in the frame is a circular shape, wherein the knock pin is fixed into the second hole, and wherein the first hole having the elongated round shape has parallel surfaces, and a width W of the parallel surfaces is equal to tens of microns larger than a diameter of the knock pin.

10. The scroll compressor according to claim 1, wherein the first hole disposed in the fixed scroll is formed in a circular shape and the second hole disposed in the frame is formed in an elongated round shape, wherein the knock pin is fixed into the first hole, and wherein the second hole formed in the elongated round shape has parallel surfaces, and a width W of the parallel surfaces is set to be equal to tens of microns larger than a diameter of the knock pin.

11. A scroll compressor, comprising:

a hermetically sealed container including at least a cylindrical center shell; and a compression mechanism unit that is disposed in the hermetically sealed container and includes a frame, a fixed scroll having a fixed wrap, and an orbiting scroll having an orbiting wrap which is engaged with the fixed wrap, and disposed between the frame and the fixed scroll, wherein the fixed scroll includes a cylindrical portion which is formed in a circumferential direction on an outer circumferential side of the fixed wrap and a flange which is provided in the circumferential direction further outside of the cylindrical portion, the frame includes an inner circumferential surface into which the cylindrical portion of the fixed scroll is inserted and fitted and a flange which is provided in the circumferential direction further outside of the inner circumferential surface, and the scroll compressor further comprises:

a pin that positions and fixes the fixed scroll and the frame in a rotational direction; and a weld that fixes at least one of the frame and the fixed scroll to the hermetically sealed container, wherein a first portion of an outer surface of the frame below the flange of the frame in an axial direction extends outward in a radial direction less than a second portion of the outer surface of the frame that is below the first portion in the axial direction and that contacts an inner surface of the cylindrical center shell.

* * * * *